United States Patent [19]

Winkowski

[11] Patent Number: 4,719,730

[45] Date of Patent: Jan. 19, 1988

[54] ACOUSTICAL TACK BOARD

[75] Inventor: Daniel A. Winkowski, Tonawanda, N.Y.

[73] Assignee: National Gypsum Company, Dallas, Tex.

[21] Appl. No.: 943,904

[22] Filed: Dec. 19, 1986

[51] Int. Cl.[4] ..... E04B 1/82

[52] U.S. Cl. ..... 52/238.1; 52/144; 52/809; 52/506

[58] Field of Search ..... 52/144, 145, 36, 238.1, 52/792, 794, 809, 506, 511

[56] References Cited

U.S. PATENT DOCUMENTS

| | | | |
|---|---|---|---|
| 3,460,299 | 8/1969 | Wilson | 52/144 |
| 3,748,799 | 7/1973 | Tough | 52/144 |
| 3,878,032 | 4/1975 | Larsson | 52/144 X |
| 3,934,382 | 1/1976 | Gartung | 52/144 |
| 4,245,448 | 1/1981 | Agar | 52/512 X |
| 4,437,542 | 3/1984 | Yeager et al. | 52/144 X |

*Primary Examiner*—J. Karl Bell

*Attorney, Agent, or Firm*—Robert F. Hause; Laird F. Miller

[57] ABSTRACT

A demountable partition wall with laminated panels hung from a wall framework by clips applied to the back of the panel. The panels are sound absorbing tack boards, consisting essentially of a gypsum wallboard base board, a mineral fiber board core board and a porous decorative sheet of material adhered to the core board.

20 Claims, 2 Drawing Figures

ACOUSTICAL TACK BOARD

BACKGROUND OF THE INVENTION

This invention relates to a novel predecorated, sound absorptive tack board particularly adapted for use in a partition wall system involving hanging wall panels on horizontal channels mounted in the wall framework.

A partition wall is disclosed in U.S. Pat. No. 4,245,448 in which wall panels are hung on horizontal channels, using a pair of metal clips. One of these clips is a plate with panel piercing tangs to the back side of a gypsum board panel. The other clip is slidingly received in the center portion of the plate and is hung over the edge of the horizontal channel, pulling the gypsum board panel tightly against the wall framework. The gypsum board, panels used in constructing this wall are usually of the predecorated type, having a vinyl or fabric facing adhered to the front face of a paper covered gypsum board.

Architects, in designing buildings, often have need for sound absorbing materials and for bulletin boards of the tack board type. Accordingly a need existed for a panel suitable for use in the partition wall system of U.S. Pat. No. 4,245,448 which had sound absorbing characteristics and also for a panel which had the characteristics of a tack board.

SUMMARY OF THE INVENTION

The present invention contemplates combining, into a single wall partition panel, a relatively thin paper covered gypsum board, a relatively thin consolidated porous board formed of fiberglass, and an acoustically porous decorative facing material.

It is an object of the invention to provide a composite wall panel suitable for use as a sound absorbing tack board.

It is a further object to provide such a panel suitable for mounting by clips having panel piercing tangs and portions hung over the edge of a horizontal channel.

It is a still further object to provide such a panel having the combination of desirable sound absorption, low sound transmission, and low flame spread characteristics.

These and other objects and advantages of the invention will be more fully apparent when considered in relation to the preferred embodiments thereof as set forth in the specification and as shown in the drawings in which.

DESCRIPTION OF THE PREFERRED EMBODIMENTS

Figure 1:
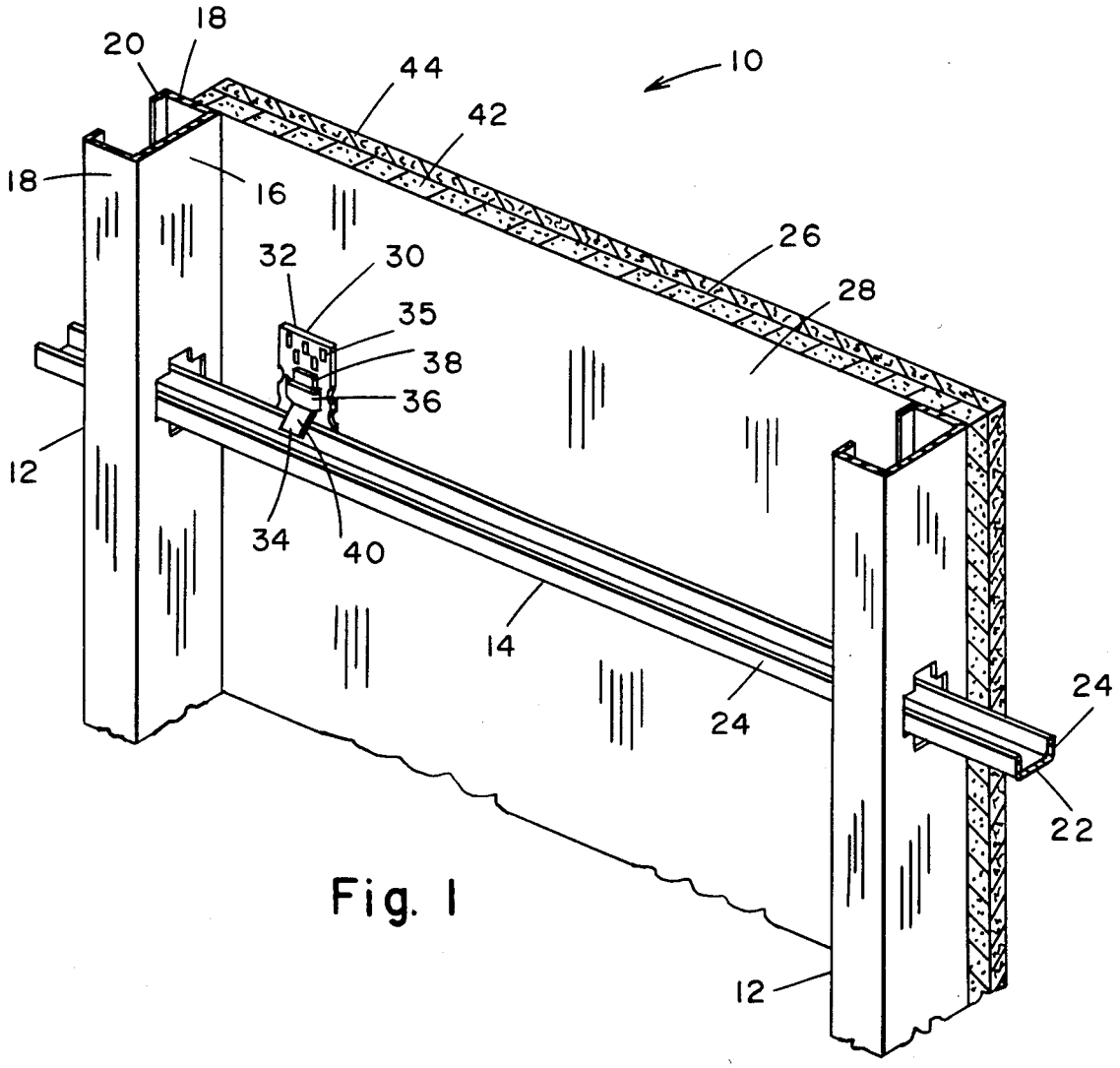
FIG. 1 is an isometric view of a partially constructed partition wall constructed in accordance with the invention.
Figure 2:
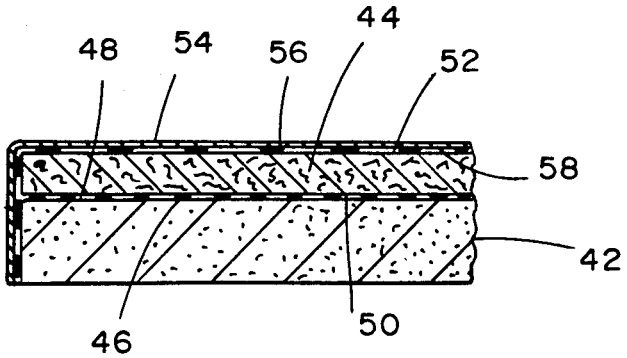
FIG. 2 is an end sectional view of a panel embodying the present invention.

Referring to FIG. 1, there is shown a partially constructed partition wall 10, including vertical metal studs 12 and a horizontal metal channel 14. Studs 12 are of a channel-form cross section including a web 16 and flanges 18, with short, inwardly directed stiffening flanges 20 at the remote edge of each flange 18. The webs 16 have holes through which the horizontal metal channel 14 extends.

The metal channel 14 includes a horizontal web 22 and two upwardly directed flanges 24.

An acoustical, tack board panel 26 is shown with its back surface 28 affixed firmly against the studs 12, held firmly in place by suspension assemblies 30.

Suspension assemblies 30 include a plate portion 32 and a separate suspension clip 34, as fully disclosed and described in U.S. Pat. No. 4,245,448, which said disclosure is hereby embodied herein by reference. Plate portion 32 includes short panel piercing tangs formed by partially severing small elongate sections 35 of the plate portion 32, which severed portions are bent 90° for penetrating the back surface 28 of panel 26. A narrow neck portion 36, on plate portion 32, forms channel means to receive the upper portion 38 of the suspension clip 34. The lower portion 40 of the suspension clip 34 is inclined outwardly to engage the horizontal channel 14.

Panel 26 is suspended from the support structure by the suspension assemblies in a manner which results in the panel 26 being urged tightly against the studs 12 by the weight of the panels, which urges the suspension clip 34 downwardly into the horizontal channel 14.

Panel 26, in accordance with the invention, consists of gypsum base board 42 to which a rigid, high density, glass fiber core board 44 is adhered with adhesive beads 46. The adhesive beads 46 are applied as substantially cylindrical elongate beads of about 1/16 inch diameter located about every ¼ inch, using Valco adhesive application equipment, on either the gypsum board front surface 48 or the core board back surface 50.

The glass fiber core board front surface 52 has adhered thereover an acoustically transparent, thin, decorative wall face surface laminate 54, which is bonded to the surface 52, and the core board and gypsum board edges, with adhesive beads 56, of 1/16 inch diameter, spaced apart about every ½ inch to 1 inch.

The gypsum baseboard 42 is a standard ½ inch paper covered gypsum core wallboard, however the gypsum board thickness could vary from about ⅜ to ⅝ inch, if desired.

The core board 44 could be composed of any mineral fiber, about ¼ inch thick, porous, and of about 10 pounds per cubic foot density.

The acoustically transparent decorative wall face surface laminate 54 is preferably an acrylic latex backed fire retardant grade fabric, such as a 100% fire retardant treated woven polyester fabric. The face surface laminate 54 may also be a woven fiberglass fabric, of a suitable weight to hide the core board 44 and adhesive beads 56, and sufficient porosity to permit sound waves to pass through and be absorbed by the core board interstices.

The face surface laminate 54 may also be a needle perforated plastic film such as a predecorated sheet of polyvinyl chloride, predecorated with a pattern identical to standard unperforated, vinyl faced predecorated gypsum wallboards. The needle perforations in such a plastic film would need to be located about ¼ inch center to center throughout the full extent of the face surface laminate. With matching predecorated patterns, the novel panel 26 could be used in walls also including similarly patterned standard vinyl faced predecorated gypsum wallboard.

The openness or porosity of the face surface laminate 54, of fabric or of needle perforated plastic film, should be sufficient to produce a panel 26 having at least about a 35 noise reduction coefficient (NRC) and preferably about a 50 NRC.

Although the face surface laminate 54 is preferably adhered to the core board 44 by extruded adhesive beads 56, an adhesive may, instead, be spray applied, or roll coated, onto the laminate back surface 58, if applied in small enough quantities to not close the pores or openings through the laminate 54. A thermosetting or thermoplastic adhesive material may be applied to the laminate back surface 58, which is activated by a heated roll during application of the laminate 54 to the core board 44.

Having completed a detailed disclosure of the preferred embodiments of my invention, so that others may practice the same, I contemplate that variations may be made without departing from the essence of the invention.

I claim:

1. A laminated acoustical tack board panel comprising a gypsum board base board, a rigid, porous mineral fiber board core board, and a thin, porous, wall face surface laminate, adhesively affixed to said core board front surface and to the edges of said core board and said base board by an adhesive disposed on said wall face surface laminate, so disposed as to not substantially lessen the porosity thereof, said wall face surface laminate on said core board edges and said base board edges forming the sole edge framing element of said panel.

2. A laminated acoustical tack board panel as defined in claim 1 wherein said wall face surface laminate is a woven fabric.

3. A laminate acoustical tack board panel as defined in claim 1 wherein said wall face surface laminate is a perforated plastic sheet.

4. A laminated acoustical tack board panel as defined in claim 1 wherein said core board is formed of glass fibers.

5. A laminated acoustical tack board panel as defined in claim 4 wherein said glass fiber core board is about ¼ inch thick and about 10 pounds per cubic foot density.

6. A laminated acoustical tack board panel as defined in claim 1 wherein said core board is adhered to said base board by a plurality of spaced apart parallel adhesive beads, of about 1/16 inch diameter located about every ¼ inch.

7. A laminated acoustical tack board panel as defined in claim 1 wherein said base board is a paper covered gypsum core wallboard of about ⅜ to ½ inch thickness.

8. A laminated acoustical tack board panel as defined in claim 2 wherein said woven fabric is an acrylic latex backed fire retardant polyester fabric.

9. A laminated acoustical tack board panel as defined in claim 2 wherein said woven fabric is a fiberglass fabric.

10. A laminated acoustical tack board panel as defined in claim 3 wherein said perforated plastic sheet is a needle perforated polyvinyl chloride sheet.

11. A partition wall comprising a plurality of parallel spaced apart vertical metal studs, a plurality of horizontal channels extending through holes in the webs of said metal studs, and a plurality of panels mechanically attached to said horizontal channels, at least one of said panels being a laminated acoustical tack board panel as defined in claim 1, said panels being attached to said horizontal channels by suspension assemblies which include means for penetrating the backs of said panels and means for hanging the panels on said horizontal channels.

12. A partition wall as defined in claim 11 wherein said suspension assemblies each consisting of a pair of cooperative elements, one of said elements having said means for penetrating the backs of said panels and the other of said elements having said means for hanging the panels on said horizontal channels.

13. A partition wall as defined in claim 12 wherein said means for penetrating the backs of said panels consists of a plurality of short panel piercing tangs formed by partially severing small elongate sections of a plate-like clip, said plate-like clip further having a channel means to receive the upper portion of the element for hanging the panels on said horizontal channels, said element for hanging the panels on said horizontal channels further including a lower portion inclined outwardly to engage said horizontal channels.

14. A partition wall as defined in claim 11 wherein said laminated acoustical tack board panel has a woven fabric wall face surface laminate.

15. A partition wall as defined in claim 11 wherein said laminated acoustical tack board panel has a perforated plastic sheet wall face surface laminate.

16. A partition wall as defined in claim 11 wherein said core board is formed of glass fiber and is about ¼ inch thick and about 10 pounds per cubic foot density.

17. A partition wall as defined in claim 11 wherein said base board is a paper covered gypsum core wallboard of about ⅜ to about ½ inch thickness.

18. A partition wall as defined in claim 14 wherein said woven fabric is an acrylic latex backed fire retardant polyester fabric.

19. A partition wall as defined in claim 14 wherein said woven fabric is a fiberglass fabric.

20. A partition wall as defined in claim 15 wherein said perforated plastic sheet is a needle perforated polyvinyl chloride sheet.

* * * * *